United States Patent [19]

Wood et al.

[11] 4,240,180

[45] Dec. 23, 1980

[54] FIBER FEEDING APPARATUS FOR CARDING MACHINES AND THE LIKE

[75] Inventors: Dennis E. Wood, Fairport, N.Y.; Charles R. Auten, Charlotte; Paul L. Dellinger, Jr., Gastonia, both of N.C.; Gary M. Holland, Fort Mill, S.C.; Eddy W. Bullington, Gastonia, N.C.

[73] Assignee: Rando Machine Corporation, Macedon, N.Y.

[21] Appl. No.: 10,172

[22] Filed: Feb. 7, 1979

[51] Int. Cl.[3] ..... D01G 15/40; D01G 23/08

[52] U.S. Cl. ..... 19/105; 19/300

[58] Field of Search ..... 19/0.23, 65 R, 65 A, 19/89, 97.5, 105, 300, 303, 304, 305, 306–308; 406/70, 171; 302/28, 17; 222/55

[56] References Cited

U.S. PATENT DOCUMENTS

| | | | |
|---|---|---|---|
| 2,770,843 | 11/1956 | Strother | 19/97.5 |
| 3,512,218 | 5/1970 | Langdon | 19/306 |
| 3,567,288 | 3/1971 | Wood | 19/65 A |
| 3,728,759 | 4/1973 | Hergeth | 19/105 |
| 3,744,092 | 7/1973 | Auten | 19/300 |
| 3,930,285 | 1/1976 | Wornall | 19/65 A |
| 4,097,965 | 7/1978 | Gotchel et al. | 19/306 |
| 4,154,485 | 5/1979 | Lytton et al. | 19/105 X |
| 4,161,052 | 7/1979 | Erben | 19/105 X |
| 4,176,988 | 12/1979 | Latt mann et al. | 19/105 X |

*Primary Examiner*—Louis Rimrodt

*Attorney, Agent, or Firm*—Shlesinger, Fitzsimmons & Shlesinger

[57] ABSTRACT

In this pneumatic feeding system fibers are conveyed by air to surge sections formed in the upper ends of vertical branch ducts. Two sets of feed rolls are mounted in the midsection of each duct beneath the lower end of its surge section to feed fibers downwardly onto a kicker roll, which opens the fibers and directs them downwardly through a tapered duct section and onto a rotating screen condenser which is mounted in the lower end of each vertical duct. The fibers are withdrawn in a uniform layer from each screen by a doffer roll, and are fed to the feed assembly of a web forming machine. In one embodiment the density of the fibers in the surge section of a duct is controlled by selectively admitting atmospheric air to the duct adjacent its midsection, while in another embodiment this control is effected by adjusting the rate of flow of air in a closed air flow system. An adjustable accelerator plate can be mounted in the midsection of each duct adjacent its associated kicker roll to control the rate and direction of flow of air and fibers through the duct.

16 Claims, 9 Drawing Figures

FIBER FEEDING APPARATUS FOR CARDING MACHINES AND THE LIKE

This invention relates to fiber feeding apparatus, and more particularly to apparatus for supplying fibers to carding machines or to machines for forming random fiber webs and the like.

There are numerous, known systems for pneumatically supplying fibers to carding machines and the like. In certain such systems (see for example U.S. Pat. Nos. 3,512,218 and 3,567,288) air-borne fibers are fed through a main, overhead supply duct selectively to one or more branch ducts, which are connected at their upper ends to the supply duct and at their lower ends to, for example, a carding machine, or a machine for manufacturing non-woven fiber webs. Normally the fibers accumulate in the branch duct to a predetermined level, and as needed, are drawn from the bottom of the duct and fed in the form of a fiber batt to the lickerin normally located at the input to the associated machine. Although various mechanisms have been developed for effecting the transfer of fibers from the supply duct to the associated machine such prior mechanisms have not proved to be entirely satisfactory.

For example, the quality of the product produced by the associated carding or web-producing machine is directly related to the uniformity of the fiber batt, which is formed in the branch duct for delivery to the input lickerin of the machine. Prior fiber feed and batt forming mechanisms, however, have not been able to produce a batt of completely satisfactory quality, as far as its physical properties such as density, uniformity of thickness, etc., are concerned.

Another problem with fiber processing systems of the type described is that, as a general rule, they are high consumers of electrical energy, since most of the power required by each system is supplied by electrically-operated motors. As a consequence, it is essential that fiber feed and batt forming mechanisms of the type described be designed as efficiently as possible, thereby to minimize their energy requirements.

Still another object in a system of this type is to prevent undue compaction of the fibers stored in the branch duct and ready for delivery to the batt forming mechanism in the lower end of the duct. The air or gas which is used to convey fibers to the branch ducts also tends to compress the fibers stored in the upper end of the duct, and unless carefully controlled may contribute unnecessarily to the energy which will be required for producing the batt that is ultimately fed to the input of the associated carding machine, or the like.

It is an object of this invention, therefore, to provide an improved pneumatic fiber distribution system in which air-borne fibers are transferred from a supply duct to an associated carding machine, or the like, with a maximum degree of efficiency, and with a minimum consumption of power.

Another object of this invention is to provide for a fiber supply system of the type described improved means for controlling the uniformity of the batt which is formed in each branch duct of the system for delivery to the lickerin of the associated card or web producing machine.

A further object of this invention is to provide improved means for controlling the flow of fibers through a branch duct of the type described, thereby to minimize the energy requirements for producing a batt from such fibers.

A more specific object of this invention is to provide improved apparatus for controlling the air flow and fiber compaction in the branch ducts of a fiber supplying system of the type described.

Other objects of the invention will be apparent hereinafter from the specification and from the recital of the appended claims, particularly when read in conjunction with the accompanying drawings.

In the Drawings

Figure 1:
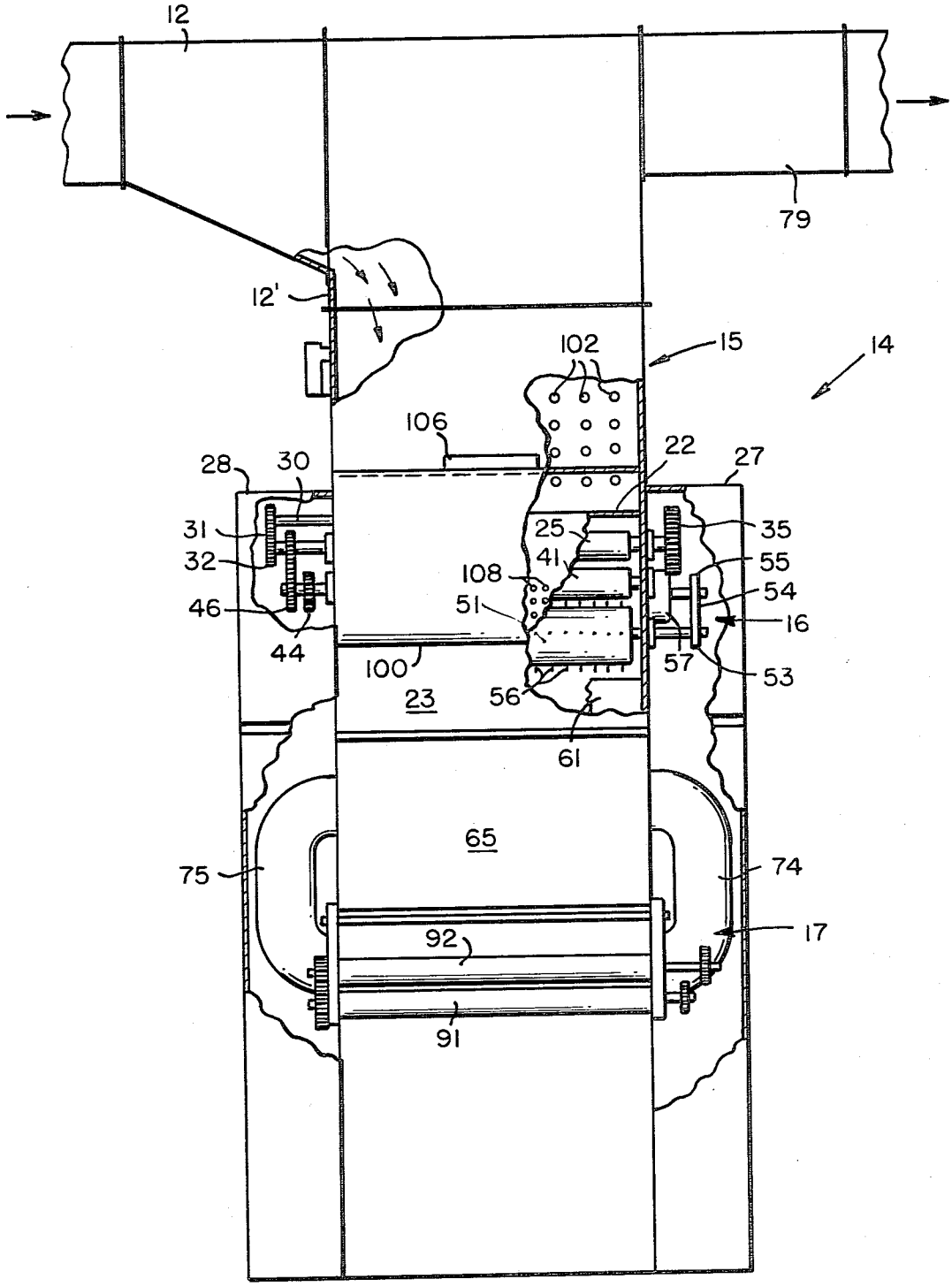
FIG. 1 is a fragmentary front elevational view of part of a fiber distribution system and a branch duct thereof made according to one embodiment of its invention, portions of the branch duct being cut away for purposes of illustration.
Figure 2:
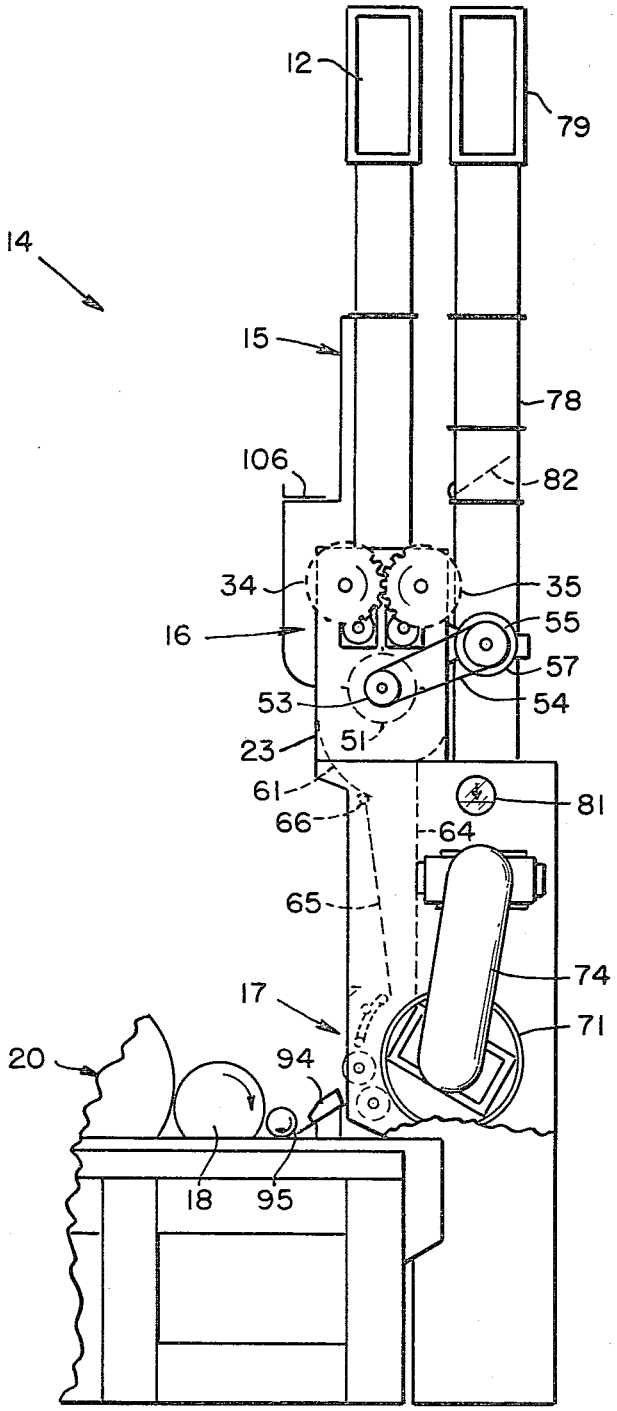
FIG. 2 is a fragmentary end elevational view of this branch duct with portions thereof cut away, and showing in part the carding machine which is adapted to be fed by the batt forming mechanism located in the lower end of this duct.
Figure 3:
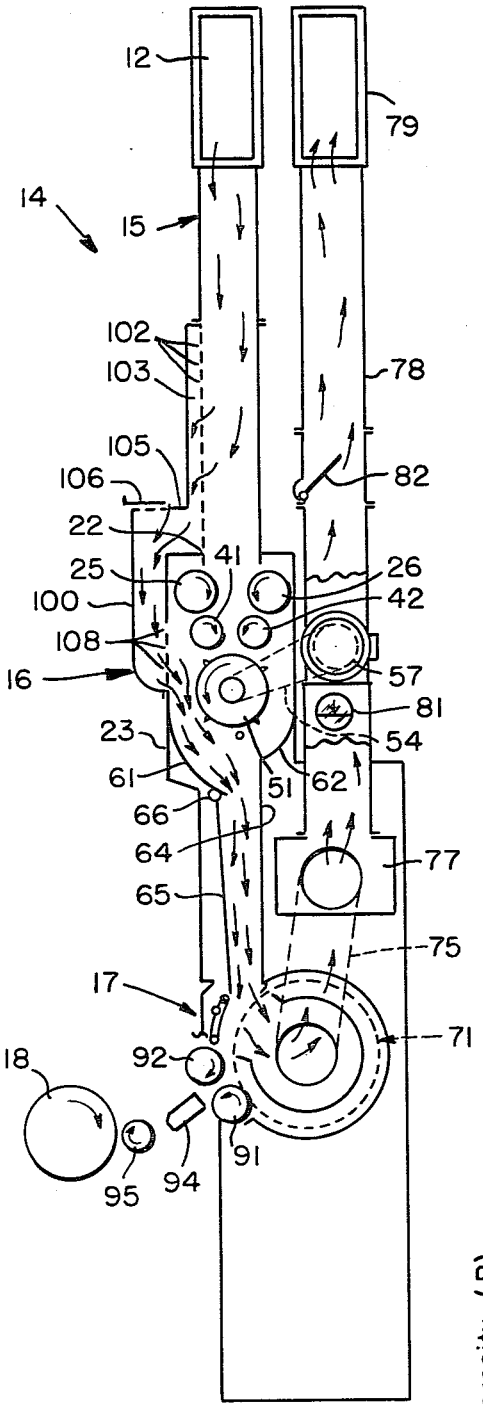
FIG. 3 is a schematic end view generally similar to FIG. 2, and showing the directions in which air and fibers flow through the branch duct.

Referring now to the drawings by numerals of reference, and first to FIGS. 1 to 3, numeral 12 denotes the main supply duct of a fiber circulating system which uses a gaseous medium (for example, air) under pressure for conveying well-opened fiberous materials to a plurality of vertically disposed branch ducts or chutes, one of which is denoted generally by the numeral 14 in the drawings. Each feed chute 14 comprises an upper, surge section 15, an intermediate or fiber opening section 16, and a lower, mat or batt-forming section or stage 17. The output of stage 17 is fed by a feed roll to the lickerin 18 of a conventional carding machine 20, or the like, only a portion of which is shown in FIG. 2.

In each feed chute 14 the associated surge duct 15 is connected at its upper end to one of the distribution points 12' (FIG. 1) of the supply duct 12, and is sealingly secured at its lower end as at 22 to an opening in the upper end of fiber kicker or opener housing 23, which is generally rectangular in configuration. Rotatably journaled at opposite ends in the side walls of the housing 23 adjacent its upper end are two, spaced, parallel, horizontally disposed feed rolls 25 and 26, which form an upper or first feeding stage in housing 23. The operating shafts for these two rolls project through the side walls of housing 23, and into the upper ends of a pair of duct housings 27 and 28 (FIG. 1), which are secured to opposite sides of housing 23, and which extend downwardly beyond the batt forming section 17 of the apparatus.

A motor-controlled drive shaft 30, (FIG. 1) which extends into housng 28 parallel to the operating shaft of feed roll 26, carries a drive spocket which is drivingly connected by chain 31 to a further spocket wheel 32, which is fixed to the operating shaft of roll 26, so that whenever the shaft 30 is driven the feed roll 26 will be rotated by the chain 31. The opposite end of the operating shaft for the roll 26 has secured thereon the rotation in the housing 27 a spur gear 34, which meshes with a similar gear 35 fixed to the adjacent end of the operating shaft for roll 25, so that the rotation of roll 26 is transmitted through the gears 34, 35 to the roll 25.

Rotatably journaled at opposite ends in the side walls of housing 23 beneath and parallel to the first stage feed rolls are two additional, or second stage, feed rolls 41 and 42. The nip or space between these two rolls is slightly less than that between the two upper rolls 25 and 26, as will be apparent from examination of FIG. 3. The operating shafts of the rolls 41 and 42 project beyond the side of housing 23 into housing 28, and have secured thereon a pair of meshing spur gears 44 which cause these two rolls to rotate in unison. Rotation is imparted to the operating shaft of one of the two rolls 41 and 42 be means of a gear train 46, which connects the last-named operating shaft to the operating shaft for roll 26. As a consequence, all four rolls 25, 26 and 41 and 42 are driven in unison, although not necessarily at the same rate.

Also rotatably journaled at opposite ends thereof in the side walls of the housing 23, and extending transversely across the center of the housing directly beneath the nip formed between the lower feed rolls 41 and 42 is kicker roll or fiber opening cylinder 51. The operating shaft for the roll 51 projects at one end (the right end in FIG. 1) beyond housing 23 into housing 27, and has secured thereon a pulley 53. This pulley is connected by a belt 54 to a drive pulley 55, which is fastened to the operating shaft an electric motor 57, which is mounted in housing 23 rearwardly of the kicker roll 51.

The opening cylinder or kicker roll 51 preferably has thereon a surface covering of metallic card clothing or a suitable arrangement of pins 56, which project radially and equidistantly beyond the periphery of the roll of engage fibers that are fed downwardly by the first and second stage feed rolls, as noted hereinafter.

Secured along its upper edge to the inside surface of the front wall of housing 23 approximately in horizontal registry with the axis of the kicker roll 51, and curving downwardly and inwardly toward the interior of the housing is an internal baffle or guide plate 61. This plate extends transversely of housing 23 between its side walls and has a concavedly shaped surface which is disposed in radially spaced confronting relation to the kicker roll 51, so that fibers driven downwardly by the roll 51 are guided inwardly toward the center of housing 23. Rearwardly of the kicker roll 51 the housing 23 has a curved, rear wall portion 62, which is radially spaced from the underside of roll 51. Portion 62 is integral along its lower end with the upper edge of a fixed vertically disposed plate 64, which forms the rear wall of a duct section which conveys fibers downwardly from the kicker roll 51 toward the batt-forming section 17 of the chute. The front wall of this duct section is formed by an inclined plate 65, which is hingedly mounted along its upper edge as at 66 to pivot about a horizontal axis which extends transversely between the side walls of housing 23 along the lower edge of the curved guide plate 61.

As a result of this contruction, after fibers pass through the kicker or opener section 16 of the chute 14, they pass into the upper end of a tapered duct section having the vertically disposed rear wall 64, and the pivotal front wall 65, which is adjustably inclined to the vertical so that the cross sectional area of this duct section decreases progressively as the lower end of the section is approached.

The opening in the lower end of the duct defined by the walls 64 and 65 opens onto the surface of a rotating condenser screen or drum 71, which is mounted in a conventional manner for rotation between the side walls of housing 23 about an axis that extends parallel to the axis of the kicker roll 51. Opposite ends of the bore in drum 71 are connected by ducts 74 and 75 to a vacuum manifold 77, which is formed on the back of housing 23 rearwardly of the duct wall 64. The manifold 77 is connected by a vertical duct 78 to a horizontally disposed vacuum supply duct 79, which extends above the apparatus adjacent to the fiber supply duct 12, and which is connected to a central vacuum system of any conventional variety. Mounted in the duct 78 is a static pressure control unit having a weight control gage 81, which may be mounted in the side of the housing 23 as shown in FIG. 2. Above the pressure control unit the duct 78 contains a pivotal air damper 82 for controlling air flow through the system.

The fibers deposited on the rotating condenser drum or screen 71 are withdrawn from the screen by a doffing roll 91, which is journaled at opposite ends in the side walls of housing 23 to rotate adjacent and parallel to the condenser screen 71, and beneath the lower edge of the pivotal duct wall 65. Mounted just above the doffing roll 91 for rotation parallel thereto between the side walls of housing 23 is a compression roll 92, which cooperates with the doffing roll 91 to form a batt of the fibers that are withdrawn from the condenser drum 71. This batt is fed by the rolls 91 and 92 over a feed plate 94, which can be mounted in any conventional manner to feed the batt to the feed roll 95 and lickerin 18 of an conventional carding machine or the like.

As shown in FIGS. 1 to 3, a fresh air, or atmospheric air plenum 100 is mounted on the front of housing 23 to overlie the lower end of the duct 15. The lower portion of the front wall of duct 15 has therein a plurality of perforations 102 which communicate with a re-entrant duct 103 formed in the upper end of the phenum 100. The plenum 100 extends downwardly over the outside of housing 23 to a point adjacent the upper edge of the baffle section 61; and intermediate its ends it has a perforated, horizontally disposed section 105, which is covered by an adjustable valve plate 106. Plate 106 can be manipulated as noted hereinafter to permit atmospheric air to enter the plenum 100, and from there to enter through a plurality of perforations 108 in the forward wall of housing 23 into the interior of the housing adjacent the peripheral surface of the kicker roll 51.

In operation, the central vacuum system generates a vacuum in duct 79, thereby lowering the pressure in duct 78 and in the bore of the condenser drum 71. At the same time, air-borne fibers are fed through the supply duct 12 at a pressure slightly above atmospheric pressure, so that when a respective feed chute 14 is in need of fibers, the fibers will be diverted into the upper end of the chute by any known means, for example by decreasing the pressure at the entrance to the upper end of the chute, thereby allowing the fibrous material to enter and to fill the surge section 15. As will be apparent from the drawings, the surge duct 15 has a larger cross-sectional area than that of the feed mat formation duct as defined by the duct walls 64 and 65, and also is in the form of a non-hermetic closure, to the extent that some air is free to bypass the first and second stage feed rolls 25, 26 and 41, 42, by passing through the reentrant duct 103 and plenum 100. Moreover, even the plenum 100 can be vented to a certain extent by manipulating the valve 106 selectively to uncover apertures in the offset section 105, thereby to admit atmospheric air to opener section 16.

Despite this non-hermetic closure, however, when the surge duct 15 is filled, or nearly filled with fibers, a pressure gradient does exist to the extent that the pressure of the gaseous transport medium is greater at the upper end of duct 15 than it is at the lower end thereof adjacent to the feed rolls 25 and 26.

It is known that the resistance to the flow of the air through a bed of fibrous materials, such as a bed of the type that would be accumulated in the duct 15, causes a pressure drop across the bed which varies proportionately to the square of the flow rate. This pressure gradient produces a commonly directed air stream, which flows through the fibrous material with equal intensity over the entire cross section of duct 15, and through the column of fibrous materials deposited therein. The resultant back pressure, due to the resistance of the fibrous column, increases with the height of the column and the consequent increase in density of this fibrous mass. This increase in resistance to flow of air in the chute 14 affects the flow in the horizontal conveying duct 12, thus allowing more material to pass to the next vertical feed chute 14 in the series. Another factor affecting this fiber feeding apparatus is that the downward flow of air through the surge chute 15 has an equalizing and consolidating effect upon the column of fibers in the sense that there is a density gradient produced vertically through the column of fibers so that the upper part of the column is bulkier and has more porosity, while toward the lower end the fibrous mass increases in density.

Two properties of the fiber column are important: the characteristic size of the fibrous materials, and the looseness or bulkiness with which the fibrous materials rest in the chute. These are two means of characterization which rely on measurement of the flow rate, pressure drop and fiber compaction during the passage of gas through a fibrous mass.

In order to design the flow rates and pressure drops for vertical chutes, it is necessary to know the change in porosity of the fibrous material coupled with the effective surface area of the material and the effect of the air flow upon these parameters. During experiments two methods to calculate the parameters of flow rate, pressure drop and fibrous compaction during the passage of gas through a column of fibers have been discovered. One is based upon relating compaction of the fibrous bed or column directly to the aerodynamic forces acting on the fibrous material; and the other considers the changes in the bed or column height caused by changes in the bed porosity.

The method relating to the aerodynamic forces on the fibrous materials to bed compaction requires an independent determination of a bulk modulus by mechanical compression of the material. To make calculations simple, the bulk modulus should be constant. However, in practice, a constant bulk modulus cannot be obtained because of the non-uniform compression of the fibers and the interaction between the individual fibers in the column.

The second method has proven to be simpler and more reliable and yields a two parameter characterization giving an area-to-mass ratio ($A_R$) and a porosity (P). The area-to-mass ratio is the ratio of the effective surface area of the fibrous materials as sensed by the air flow to the dry mass of the material. This ratio provides an indication of the relative size of the fibrous mass. The porosity may be defined as the ratio of the effective free volume, also as sensed by the air flow, to the total volume, and hence gives an indication of the looseness or density of the material. For example, for fiberized bleached kraft wood pulps of equal porosity and bulk density, and increase in the area-to-mass ratio ($A_R$) would indicate a smaller aggregate size of the pulp. Similarly, for pulps of equal porosity (P) and bulk density, an increase in porosity would indicate a looser packing of the materials. Fibrous types, fiber length, diameter or denier give different area-to-mass and porosity rates.

For experimental data using air as the gaseous conveying medium, the following formula has been developed:

$$P = \frac{\Delta L}{L_x - \sqrt[3]{\frac{B_x}{B} L(L_x)^2}} \quad (1)$$

$$A_R = \sqrt{\frac{B_x(P_x)^3}{D}} \quad (2)$$

Where

P = Porosity = void volume/total bed or colume volume.

$A_R$ = Area-to-mass ratio.

$L_x$ = Original bed or column height.

L = Column or bed height after compression.

$\Delta L = L_x - L$ $$B = \frac{\Delta P}{KULV}$$

$\Delta P$ = Pressure drop across the column of fibers.

K = Constant (normally 5.56 when $P < 0.8$)

U = Dynamic viscosity of air.

V = Average velocity of the conveying air.

D = Bulk density of the fibrous material.

In the above formula, the subscript "x" refers to the original stage of the fibrous material before any compression has taken place.

Figure 4:
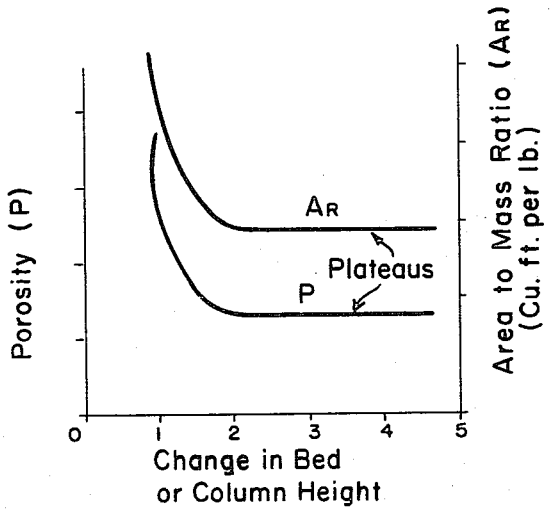
FIG. 4 is a graphical plot showing the porosity or area to mass ratio of column of fibers held in this branch duct with respect to the respective height of the column of fibers.

In a test chute connected to a pneumatic conveying system where well-opened fibers are transported by air to the diverting means at the upper end of the vertical chute, the chamber is carefully filled with fibrous materials under gravity flow conditions to produce a uniform column or bed of material. Measurement of air flow rate, pressure drop across the column, and the column height, are taken when air is passed through the column, and the column height, are taken when air is passed through the column at low flow rates, in the order of 2 CFM. The column is then compressed by using a high flow rate, which is the resultant of the calculated conveying requirements which exist in the transportation duct at the entrance to the vertical chute. Similar measurements are then taken for the compressed column of fibrous material. Calculations are then made using equations 1 and 2 for each value of compression. These values are then plotted for values of $A_R$ and P versus the change in the column height of the fibers. The graphical representation of these values as shown in FIG. 4 shows a plateau region where there is little variation in either factor. An average of several plateau values are used for each factor to characterize the fibrous material.

From these calculations, the area of plateau for each type of fibrous material, the quantity of air and its associated pressure can be determined. This is needed in the vertical chute to maintain a constant density of the material without a resultant high back pressure, which will affect the downward flow of material from the conveying duct. Hence, an equilbrium of the downward flow and pressure to the back pressure and associated upwards flow may be made ensuring a proportional downwards movement of fibrous material from the conveying duct to the lower stage of the surge chute 15 to give a uniform density and profile across the area of the chute.

The plateaus of various fibrous materials indicate the point at which the density of the mass of fibers increases the back presure, which will affect the downward movement of the fibrous flow from the conveying duct. Also the plateaus of these graphs (FIG. 4) indicate the height of the chute needed to allow for adequate compaction of the column. Fibers with high diameter to length ratios normally require more volume to achieve a porosity value equal to fibers of a low diameter to length ratio.

The non-hermetic wall of the surge chute 15 allows for the relief of the downward air flow and pressure through the column of fibrous material while retaining the fibers inside the fiber depositing chute. The size or number of uncovered opening in wall section 105 can be controlled by manipulation of slide valve 106.

The pressure of the pneumatic transporting medium in the circulating or conveying duct 12 and in the vertical surge duct 15 is higher than that of the ambient atmosphere. Because of the opening at the lower section of the duct section 15, a downward current develops in this vertical chute causing the movement of the fibers to the portions of the duct where the fiber is less dense and which therefore permits a greater flow of air, if air is used as the transport medium.

At the exit of the surge duct 15 the feed rolls 25, 26 and 41 and 42 transfer and move the fibers at an increased density due to the reduction in the cross-sectional area between the rolls. The speed of rotation of these rollers is adjustable so that the amount of fiber supplied to the feed mat formation section 17 via the kicker or opening roll 51 can be accurately controlled. These positively driven feed rolls may be provided with textured surfaces so that the fibers conveyed through the feed roll section are positively moved downwardly into the path of the opening roll 51, which opens and combs the fibers from the feed mat and passes them as individual fibers to the mat formation stage 17 of the chute.

As shown more clearly in FIG. 3, the above mentioned feed rolls are grouped as a set of four cooperating units forming therebetween a generally "V" shaped vertical space having a larger opening at the point facing the upper surge chute 15, and a much smaller opening at the point just above the opening roll 51. The feed rolls rotate inwardly toward the "V" space and in opposite directions. One set of the rolls 25, 26 and 41, 42, respectively, may be horizontally adjustable so that the distance between the rolls may be increased or decreased to suit the particular fibers being processed.

The fiber passing from the surge section 15 of the chute is further increased in density as the mass is conveyed through the group of feed rolls. The feed mat, generated through these feed rolls, is then advanced into the path of the rapidly revolving opening roll 51, which may have a surface covering of metallic card clothing, or as illustrated herein, a suitable arrangement of spikes driven at a speed to enable it to exert an opening action on the fibrous mat to loosen the fiber and render it light and fluffy.

Figure 5:
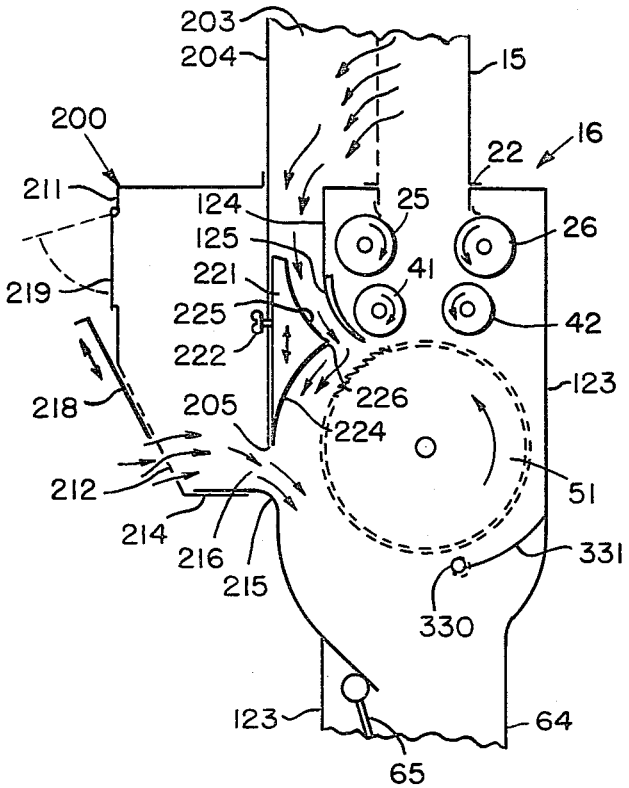
FIG. 5 is an enlarged, fragmentary schematic view of a modified form of the mid or fiber opening section of the branch duct, and illustrating one manner in which an accelerator plate may be mounted in this section in order to control the flow of fibers therethrough.

Referring now to FIG. 5, 123 denotes a modified opener housing and re-entrant duct 203 for controlling air flow through the opener section 16. In this embodiment the first and second stage feed rolls 25, 26 and 41, 42, respectively, are mounted to extend through the sides of the opener housing 123 in a manner similar to that of the feeder rolls in the first embodiment. Likewise, the kicker roll 51 is mounted to extend between opposite sides of the housing 123 beneath the lower end of the surge chute 15, and registry with the "V" shaped nip or spacing formed between the feeder rolls 25, 26 and 41, 42.

In this embodiment an opening is formed in the front wall of the housing 123 to register approximately with the kicker roll 51. The upper end of this opening is bound by a vertically extending portion 124 of the front wall of housing 123, and by an arcuate guide plate 125, which projects downwardly from the wall portion 124, and which curves at its lower edge inwardly toward the space between the feeder roll 41 and the kicker roll 51. The front wall 204 of the re-entrant duct 203 extends downwardly into the upper end of housing 123 in spaced confronting relation to portion 124 thereof, and has a lower edge 205 which terminates approximately in a horizontal plane containing the axis of kicker roll 51.

An air plenum 200, which is formed on the outside of the duct wall 204, has a vertical wall portion 211 disposed in spaced, parallel relation to the duct wall 204, and an inclined, lower wall section 212 which merges with a horizontal flange portion 214 on the front wall of housing 123. Portion 214 of the housing wall has thereon a curved surface 215, which is spaced beneath and in registry with the lower edge 205 of the duct wall 204, thereby forming in the lower end of the plenum an opening 216 which communicates with the interior of the opener housing 123 beneath the mid-point of the kicker roll 51.

The wall section 212 of the plenum has therethrough a plurality of spaced openings covered by a plate valve 218, which is slidably mounted on the exterior of section 212, and which is manually adjustable to vary the size or numbers of exposed openings in section 212, thereby to adjust the amount of atmospheric air which can be admitted through the plenum 200 to the interior of housing 123. Also, a small door 219 is hingedly mounted along the upper edge of a opening in the front wall 211 of the plenum housing to enable access to the interior of the plenum 200 for a purpose noted hereinafter.

Slideably and adjustablely mounted on the inner surface of the duct wall 204 adjacent its lower edge is an accelerator plate 221. A plurality of wing nuts 222 are threaded onto the outer ends of adjusting screws which project from plate 221 through registering, vertical slots in the wall 204, so that vertical adjustment of the plate 221 on wall 204 can be effected merely by loosening the nuts 222. Door 219 may be opened to provide access to the nuts 222.

On its surface facing the inside of housing 123, plate 221 has formed thereon two concave surfaces 224 and 225, which merge with one another to form in the center of the plate a transversely extending edge 226. The upper concave surface 225, as shown in FIG. 5, is disposed in spaced, confronting relation to the convex surface of the guide plate 125, while the lower concave surface 224 is disposed in spaced, confronting relation to the peripheral surface of the kicker roll 51. The edge or rib 226 on the accelerator plate thus faces the space between the roll 51 and the lower feed roll 41.

Preferably the accelerator plate 221 is positioned so that its rib is located at a point which forms an approximate tangent between the second stage feed roll 41 and the kicker roll 51. The purpose of this accelerator plate is to create an air current or turbulence at, or adjacent to, the tangent point between the feed rolls and the opening or kicker roll 51. It also assists in maintaining the fibers in a good open state, minimizing their tendency to accumulate or "ball-up" at this point.

In the particular embodiment illustrated in FIG. 5, the accelerator plate 221 is used in conjunction with a double air flow duct mechanism in the form of a first duct represented by the re-entrant duct 203, which directs the air flow from the openings 102 in the surge chute 15 through the space between the curved surface 225 on the accelerator plate and the confronting surface on the curved plate 125, and into the opening or combing point formed between the lower feed rolls 41, 42 and the adjacent kicker roll 51. The second duct section of this double air flow mechanism is represented by the opening 216 in the bottom of the plenum 200, which allows atmospheric air to enter into the housing 123 at a point adjacent to the horizontal center line of the kicker roll 51. In this embodiment, therefore, the accelerator plate 221 is positioned between the exit side of the feed roll 41 and the opening 216 through which air is admitted to the housing 123.

From examination of FIG. 5 it will be apparent that the lower end of the re-entrant duct 203, as defined by the space between the accelerator plate 221 and the guide plate 125, has a reduced cross-sectional area so as to accelerate the air stream at this point, and to remove fibers which would otherwise lodge at the tangent point between the feed rolls and the kicker roll. The plate 221 has a cross-sectional form of an inverted "V" profile, with the peak 226 positioned at the tangent point formed by the feed rolls 41, 42 and the opening or kicker roll 51. The upper or re-entrant surface 225 of the plate 221 is arranged to increase or at least to maintain the velocity of the air stream as it approaches the fiber opening point; and for this reason the surface 225 is formed with a tighter curve, or a smaller radius of curvature, than is the other surface 224, which confronts the periphery of the kicker cylinder or roll 51 The surface 224 generally corresponds to the curvature of the roll 51.

A doffing bar 330 is also mounted at opposite ends thereof in the side walls of the housing 123 to extend transversely beneath, and in spaced relation to, the peripheral surface of the kicker roll 51 to doff fibers therefrom in known manner. A concave shield 331 extends between bar 330 and the back wall of housing 123 to reduce turbulence from the kicker roll 51, and to allow bar 330 to work more effectively.

Figure 6:
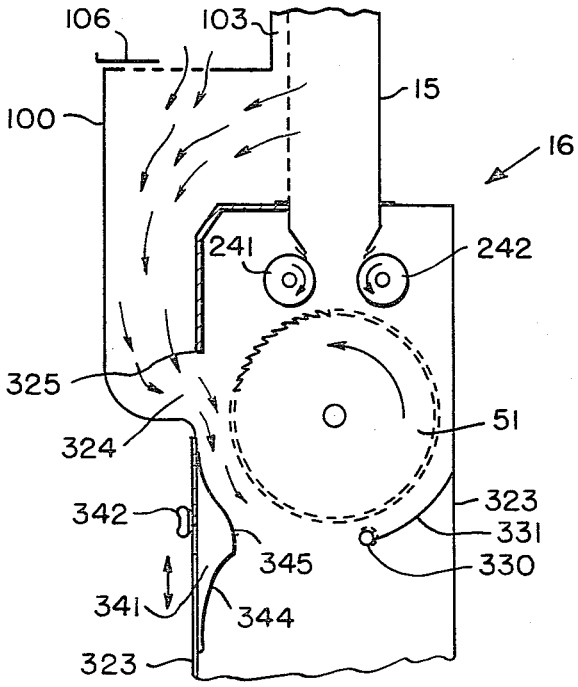
FIG. 6 is a view similar to FIG. 5 but illustrating another modification of the fiber opening section and another form of accelerator plate mounted therein.
Figure 7:
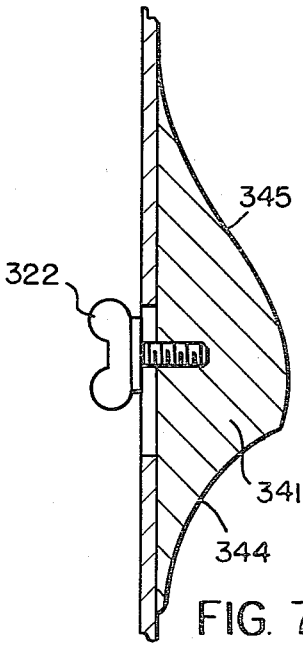
FIG. 7 is an enlarged, fragmentary view of the opener section and accelerator shown in FIG. 6.

In the embodiment shown in FIGS. 6 and 7, the plenum 100 is similar to that shown in the first embodiment, but is attached to the front side of a modified opener housing 323, which has an opening 324 in the front wall thereof at a point which registers with the kicker roll 51 adjacent the nip point thereof. In this embodiment the lower edge of the opening 324 registers with the horizontal center line of the kicker roll 51, while the upper edge 325 is positioned above the center line to the roll 51. Also in this embodiment only one set of feeder rolls 241 and 242 is shown to be mounted to extend between the side walls of the housing 323, so that the nip therebetween is positioned above and in registry with the center of the kicker roll 51.

In this embodiment a modified accelerator plate 341 is mounted on the forward wall of housing 323 immediately beneath the opening 324. This modified accelerator plate 341 is mounted for vertical adjustment on the forward wall of housing 323 by meansof a plurality of adjusting screws, which are fastened at one end of the plate, and project at their opposite ends through registering, vertical slots in the housing wall, and which are secured adjustably in place by a plurality of wing nuts 342.

The plate 341 is used in this embodiment at a point below the midpoint of the kicker or opening roll 51, and functions to contain the expanding air and fiber mixture to retain the pressure and velocity of these two components as they pass downwardly in housing 323, thus allowing the centrifugal force of the roll 51 to deflect the flow of fibers into the web formation chute (64,65) with greater control. The plate 341 is adjustable toward or away from the opening cylinder's curved surface, and hence decreases or increases the gap between these two components.

The outer surface of the accelerator plate 341 is of a modified, streamlined character, having a curvature which is optimum for the purpose of deflecting and trajecting the air currents and fibrous materials toward the mat formation condensor.

For some fibrous materials it has been found that a flat reversed "S" curve is satisfactory with the accelerator plate 341; and this configuration can be seen more readily in FIG. 7. The trailing or downwardly facing surface on the plate 341 is in the form of a concave curve 344, while the upstream end is in the shape of a reversed "S" curve 345, with its leading edge tangent to the forward wall of housing 323.

It is to be understood that the accelerator plates 221 and 341 extend transversely of the housing for distances at least equal to the width of the re-entrant duct 204 or the opening 324 in the housing in which they are mounted. Moreoever, while in the embodiment illustrated, a plurality of bolts and wing nuts are illustrated for the purpose of mounting the plates for vetical movement on their respective housing or duct walls, it is to be understood, of course, that any conventional means may be employed for mounting these plates for vertical adjustment.

Figure 8:
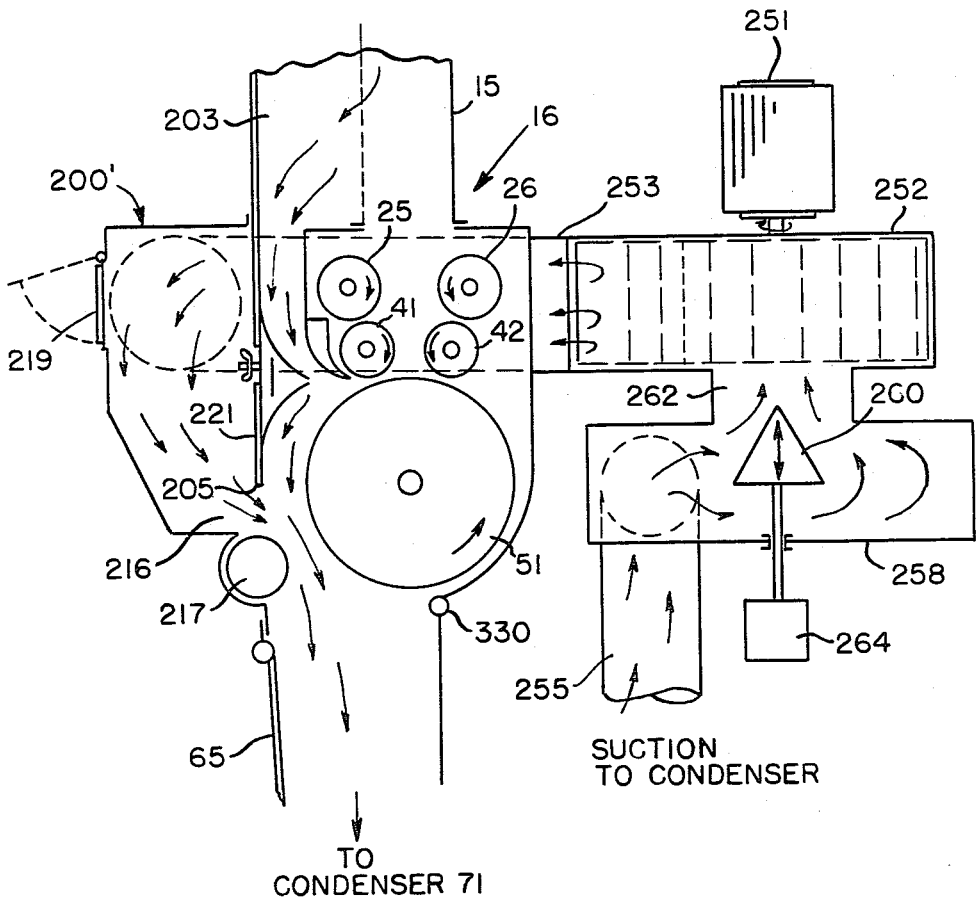
FIG. 8 is a fragmentary schematic view of a modified or closed loop system using a separate suction fan or source for each branch duct.

In the previously described examples of the fiber feeding apparatus the air flow through each system is made of two component flows, one from the surge chute 15 via the re-entrant duct 103, 203, and the other via atmospheric air which may be introduced by the various valve means 106, 218 and 219. FIG. 8, wherein like numerals are employed to denote elements similar to those used in the preceding embodiments, shows a modified closed-loop air flow system. The air stream in this system is supplied by the fan 252 which is driven by motor 251. The pressure side of fan 252 is connected by a duct 253 to a modified pressure expansion chamber 200' situated at the forward art of the fiber opening and feeding assembly. The positive air flow from this chamber enters the apparatus at a point just below the horizontal center line of the opening roll 51 and over an eccentrically pivoted saber tube 217, and then into the mat formation chute. The air then passes through the condenser 71 and is returned by a duct 255 to the suction side of the fan via a suction expansion chamber 258 which incorporates fan damper means.

The above-noted damper means comprises a generally coneshaped damper 260 having its pointed end projecting centrally into the bore of a reduced diameter duct section 262, which connects chamber 258 with the suction side of fam 252. Damper 260 is mounted in known manner for axial reciprocation by a driver 264, which is located externally of chamber 258.

The expansion chamber 258 has a larger cross sectional dimension than that of the connecting duct 262 between the positive and negative side of the fan and condenser assembly. The air flow enters the mat formation chute through the slot 216 formed by the upper position of the saber tube 217 and the lower support plate 205 of the accelerator quandrant 221. This slot 216 extends across the width of the machine and has a smaller cross sectional area providing for a "stable" air stream of higher velocity than that within the expansion chamber 258. This high velocity air stream maintains the fibers as a distinct layer in the mat formation chute until reaching the condensation means.

The positive air flow may be created by one or more fans through the duct system 253 which extends horizontally across the outside of the opening and feed roll assembly connecting the fan outlet to the pressure expansion chamber 200'. The fibers are deposited to form a mat on the continuously moving condenser screen 71 (not shown in FIg. 8); and the air is then recirculated to the fan via the duct work 255, which extends from opposite ends of the condenser's inner suction tube to the suction expansion chamber 258.

Several fans in series, or an open air system with one or more fans supplying the air and one or more fans exhausing the air, may also be used. In such a closed loop air flow the volume and pressure may be regulated via the automatic damper means so that the flow can be equated to the fiber flow and the density of the mat formed upon the condensers surface. In the continuous operation of the closed loop air system, the formaminous condenser pulls air continuously through its surface into the suction chamber situated inside the perforated cylinder; the fan suction moves the air through the duct work into the suction expansion chamber and returns the air from the positive side of the fan or fans through the connecting ductwork to the expansion duct and hence into the mat formation chamber via the high velocity nozzle formed by slot 216 above the saber tube. As the fiber is built up on the condenser's surface, the static pressure increases, which closes the fan damper 260 via the pressure sensing means as detailed in U.S. Pat. No. 3,744,092 to Auten. This action reduces the amount of air flow through the system to that proportion required by the density of the fibrous mass at the condenser.

The density of the feed mat formed on the condenser's surface is a relationship between the amount of fibrous material being processed via the feed roll system, the surface speed of the condenser, and the resistance to the air flow caused by the mass of fibers being deposited upon the condenser's surface. These three items should be combined to achieve a uniform mat of fibers at the condenser. The condenser's surface speed is dependent upon the unit weight requirement of the web forming machine, the weight is normally between 10 and 18 ozs. per square yard with a preferred weight of 14 to 16 ozs. per square yard while the surface speed would be between 0.5 to 5 feet per minute with a preferred surface speed of 1.3 to 2.5 feet per minute.

The surface speed of the condenser is obtained via either a chain drive coupled to the feed roll drive in the case of cards or garnetts, or by a variable D.C. controlled motor in the case of nonwoven web formation equipment. In either case there should be a small draft between the condenser's surface speed and that of the feed roll which may be between 5% and 8%. That is, the feed roll's surface speed would be somewhat higher than that of the condenser, so that the mat of fibrous material is conveyed at a uniform rate without any resistance between the rolls which would make the fibrous mat fracture and fold over on its self commonly referred to as "bridging". If this draft is too large then the feed mat will be drawn apart, which would result in holes or low density areas within the mat's structure. In both cases either too much or too little draft will produce nonuniformity down stream in the manufacturing process.

The resistance of the mass of fiber deposited upon the surface of the condenser to the flow of air into the condenser's interior, results in a negative (static) pressure in the condenser. This pressure acts equally in all directions and is normally measured in inches of water column. If the mass of fiber is able to fluctuate then the resistance to this mass will likewise fluctuate and will cause an uneven density of fibers during these fluctuations. It is known that if the static pressure of the air flow is controlled between known limits then the density of the fibrous mass will become more uniform.

The resistance to flow or the static pressure is independent of the air velocity. It is normal practice to provide for a known air velocity within such aerodynamic forming systems which in turn determines the quantity of air used within the unit since by multiplying the air velocity by the cross sectional area of the duct or passage way you can determine the air volume flowing past that point per unit of time.

The measure of control of the static pressure fluctuations within the condenser does not provide for complete control of the fiber density, if the amount of fibrous material being processed through the unit is uncontrolled, since the amount of fiber deposited upon the condenser's surface can be independent of the static pressure fluctuations are used to control the amount of fiber flow then a more uniform density profile will result within the feed mat.

Pressure measurements normally measure the difference between applied pressure and ambient pressure, typically atmospheric pressure. However, since the system under consideration is dependent upon the frontal pressure within the formation chute, and that within the condenser, then a working relationship between these two pressures should be considered. The difference between these two pressures is called the differential pressure.

There are many instruments which will measure such differential pressure. However, in this invention any fluctuations in the differential pressure needs to be translated into an an electrical signal, which may then be used to control better the surface speed of the feed rolls, and the movement of a fan damper, which in turn controls the static pressure by known means (see U.S. Pat. No. 3,744,092 to C. R. Auten). Hence the amount of fiber flow within the feed system is also controlled.

Figure 9:
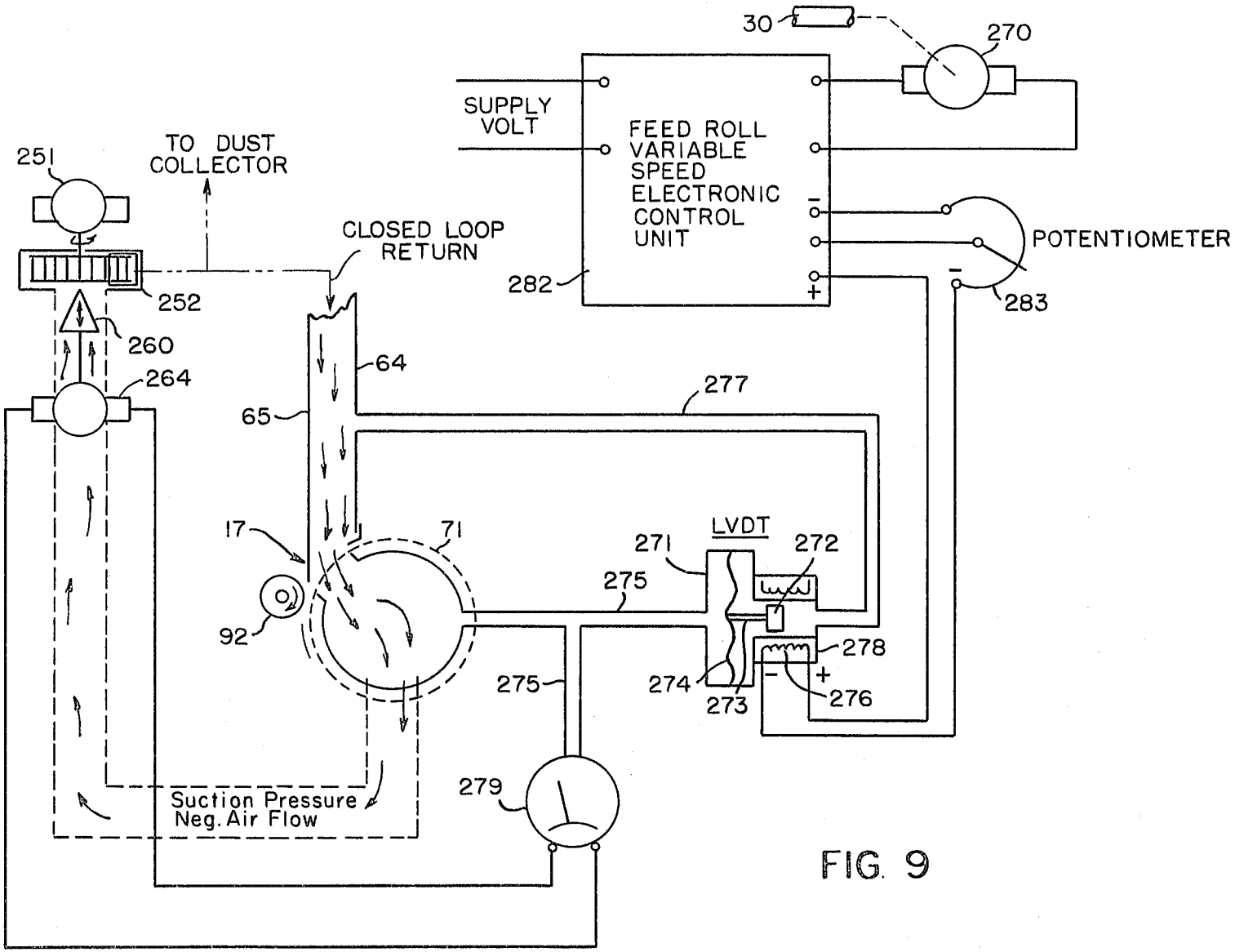
FIG. 9 is a diagram showing one combination of electric and pressure-responsive control means which can be employed with systems of the type illustrated herein.

One such mechanism for controlling the feed roll drive and the damper 260 is shown schematically in FIG. 9, wherein the numeral 270 denotes a variable D. C. controlled drive to move the feed rolls 25, 26, 41, 42 at any required surface speed. In this embodiment the preferred method of sensing the differential pressure lis with use of a pressure transmitter 271 of the Lincar Variable Differential Transformer (LVDT) type, although pressure transducers may be used.

This pressure sensing system does not utilize any levers, gears or other linkages. It consists of a magnetic core 272 fastened directly by a short stem 273 to a metal capsule or diaphragm 274, which is connected at one side by a line or tube with the interior of condenser 71. The static pressure causes expansion of the capsule and a corresponding movement of the core 272, which is enclosed by an electrical coil 276, thus producing a corresponding change in LDVT electrical output. This output signal is linear and hence directly proportional to the applied pressure. The higher the pressure the higher the output voltage. LVDTs are manufactured by Computer Instruments Corporation of Long Island, New York. Other units such as pressure transducer are manufactured by Robinson-Halpern Company of Plymouth Meeting, Pennsylvania.

The pressure in the formation chute 64, 65 is applied by a line 277 to a metal isolating chamber 278 which surrounds the capsule 276 and acts to compress the capsule and thus opposes the condenser pressure and its core motion. When pressure is applied to both sides of the capsule simultaneously, the units output becomes proportional to the pressure difference.

The line 275 is also connected to a photohelic control device 279, which forms part of the above-noted mechanism disclosed in U.S. Pat. No. 3,744,092 for controlling damper 260 in response to changes in the pressure in the condenser 71

Known variable speed motor controllers generally have a small signal voltage circuitry 282 associated with a speed control potentiometer 283. The variable set point of this potentiometer provides a reference signal voltage and/or a bias point of a linear amplifier which sets the gain of this amplifier. This system is widely used in silicone Control Amplifiers (SCR) type D.C. motor controllers, A.C. variable frequency motor controllers and D.C. servo amplifiers.

By connecting the signal output voltage of the LVDT in opposite polarity to the speed potentiometer, the motor speed is decreased as the pressure increases; and likewise, as the pressure decreases the speed of the motor is increased. This increase or decrease of the motor speed with respect to the pressure will forward more or less fibrous material into the path of the opening roll and thus provide more or less material for mat formation upon the condenser's surface.

By controlling the static pressure within the condenser via the fan damper, and by providing the required amount of fiber via the LDVT controlled variable motor drive, the fibrous mat density may be maintained within very narrow limits. In operation the potentiometer speed control, which is conventional and therefore not disclosed in detail, is adjusted so that its associated variable speed motor, which in turn is connected to the feed roll drive 30, delivers the proper amount of fibrous material from the surge chute 15 to the condenser 71, when the differential pressure is at or near zero. As the mat density at the condenser's surface begins to increase, the static pressure or the resistance to the air flow will likewise increase. This increase in pressure moves the core of the LVDT to increase its signal voltage. This increase in voltage decreases the motor speed by virture of the reversed polarity to the potentiometer. This automatically regulates the speed of the motor 270 and thus regulates the fiber flow to the condenser to maintain as near as possible an equilibrium in fiber density, and thereby maintaining a uniform feed mat weight.

Having thus described our invention, what we claim is:

1. In a pneumatic fiber feeding system, apparatus for feeding fibers from a main fiber supply duct to a carding machine or the like, comprising a vertical branch duct having a surge section in its upper end connected to said main duct to receive air-borne fibers therefrom, a pair of feed rolls rotatably mounted in said branch duct adjacent the lower end of said surge section normally to cause a column of fibers from the supply duct to accumulate in said surge section, a rotatable kicker roll mounted beneath said feed rolls in an opener section of said branch duct, and in registry with the nip formed between said feed rolls, means for simultaneously driving said feed and kicker rolls, whereby fibers are fed by the feed rolls downwardly from said surge section into the path of the rotating kicker roll, which opens the fibers and directs them downwardly through a batt forming sectic in the lower end of said branch duct, suction mea. connected to the bottom of said branch duct to maintain a pressure drop as between the air pressure in said surge and said batt forming sections, respectively, of said duct, whereby air tends to flow downwardly in said duct and through the column of fibers accumulated in said surge section, a condenser mounted adjacent the lower end of said branch duct and having thereon a foraminous surface positioned to travel past an opening between said batt forming section and said suction means, whereby fibers which pass through said batt forming section are deposited in the form of a thin, fibrous matt on said travelling surface for delivery thereby to a carding machine or the like, and control means on said branch duct between said surge and said batt forming sections thereof and operable selectively to adjust the rate of flow of air downwardly through said column of accumulated fibers, thereby to control the degree of compaction of the fibers in said surge section, and the rate at which said fibers are fed to said condenser.

2. Apparatus as defined in claim 1, wherein said control means comprises a plenum mounted on said branch duct and having a chamber communicating adjacent one end with a first opening in said branch duct opposite said kicker roll and communicating adjacent its opposite end with said surge section through a plurality of spaced apertures in said branch duct above said feed rolls, and valve means on said plenum for selectively admitting air at atmospheric pressure to said chamber.

3. Apparatus as defined in claim 2, wherein said control means further comprises means for adjustably controlling the speed of rotation of said feed rolls thereby to vary the rate at which fibers are fed to said kicker roll.

4. Apparatus as defined in claim 2, including means for directing air from said surge chute into the fibers discharged from said kicker roll, comprising a partition projecting into said plenum in spaced, confronting relation to the peripheral surface of said kicker roll, and an accelerator plate removably mounted on said partition for limited vertical adjustment, and having thereon a first curved surface for directing air from said opposite end of said chamber toward the fibers discharged from said kicker roll, when said plate is mounted on said partition.

5. Apparatus as defined in claim 4, including, a second curved surface formed on said accelerator plate for guiding fibers from said kicker roll downwardly in said branch duct and past said first opening, said curved surfaces being concave and merging intermediate the ends of said plate in a line extending parallel to the axis of said kicker roll and aligned approximately with the upper surface thereof.

6. Apparatus as defined in claim 4, wherein the lower edge of said partition defines the upper edge of said first opening in said branch duct, and said accelerator plate is mounted on the inside of said branch duct beneath said first opening and has thereon a curved surface disposed in spaced, confronting relation to the lower half of said kicker roll to guide fibers toward said batt forming section.

7. Apparatus as defined in claim 2, including a doffing bar located in said branch duct beneath said kicker roll, and a concave shield extending from said bar rewardly to the wall of said branch duct opposite said first opening.

8. Apparatus as defined in claim 2, wherein said suction means comprises a second vertical duct adjacent the first-named vertical duct and connected at its upper end to a central vacuum source, and at its lower end to said condenser, and a damper in said second duct intermediate its ends and adjustable to help control the air flow through said vertical ducts.

9. Apparatus as defined in claim 1, wherein the degree of compaction of the fibers in said surge section is a function of area-to-mass ratio ($A_R$) of said fibers, and the porosity (P) of the mass of fibers accumulated in said surge section, and wherein $$P = \frac{\Delta L}{L_x - \sqrt[3]{\frac{B_x}{B} L(L_x)^2}} \quad (1)$$

$$A_R = \sqrt{\frac{B_x(P_x)^3}{D}} \quad (2)$$

Where

P = Porosity = void volume/total bed or column volume.

$A_R$ = Area-to-mass ratio.

$L_x$ = Original bed or column height.

L = Column or bed height after compression.

$\Delta L = L_x - L$ $$B = \frac{\Delta P}{KULV}$$

$\Delta P$ = Pressure drop across the column of fibers.

K = Constant (Normally 5.56 when $P < 0.8$)

U = Dynamic viscosity of air.

V = Average velocity of the conveying air.

D = Bulk density of the fibrous material.

10. Apparatus as defined in claim 1, wherein said suction means comprises a suction fan mounted adjacent said branch duct, said control means includes a reentrant duct having one end mounted over a plurality of openings formed in said branch duct above said feed rolls, and opening at its opposite end adjacent the upper peripheral surface of said kicker roll to direct air from said surge section toward the fibers discharged from said kicker roll, a fan inlet duct connects the inlet of said fan to said condenser, and a fan outlet duct connects the outlet of said fan to an opening formed in said branch duct in spaced, confronting relation to said kicker roll, and beneath said opposite end of said reentrant duct, whereby fibers discharged from said kicker roll are discharged downwardly into said batt forming section by air emanating from said surge section and from the outlet of said suction fan.

11. Apparatus as defined in claim 10, wherein said control means further comprises a damper mounted in one of the inlet and outlet ducts, respectively, and adjustable to control the rate of air flow through said fan, means for sensing the static pressure in said condenser at the side of said travelling surface remote from said batt forming section, and means responsive to changes in said static pressure and operatively connected to said damper and to said drive means to adjust the position of said damper and the speed of rotation of said feed rolls in proportion to the change in said static pressure.

12. Apparatus as defined in claim 11 wherein said sensing means comprises an electric signal generator including a chamber containing a diaphragm and connected at one side to said batt forming section of said branch duct, and at its opposite side to said condenser, whereby any increase in the pressure differential between said batt section and said condenser will produce a corresponding increase in the signal produced by said generator, and said means responsive to the changes in said static pressure includes signal-responsive means connected to said drive means and operative to decrease the speed of rotation of said feed rolls as the signal output of said generator of said feed rolls as the signal output of said generator increases, and vice versa when said output decreases.

13. Apparatus as defined in claim 10, including an accelerator plate mounted on said reentrant duct adjacent said opposite end thereof and having thereon a first curved surface for directing air from said surge section toward the discharge of said kicker roll, and a second curved section for guiding fibers discharged by said picker roll downwardly into said batt forming section and past said opening in the branch duct which is connected to said fan outlet duct.

14. In a pneumatic fiber feeding system in which each of a plurality of vertical branch ducts delivers fibers from a main, overhead supply duct to the surface of a cylindrical condenser screen which rotates in an opening in the bottom of the branch duct, apparatus for feeding fibers from an accumulated supply thereof in the upper end of each branch duct, to a batt forming section in the lower end of each duct for directing fibers onto said screen, comprising a plurality of feed rolls mounted in each branch duct and forming therebetween a nip which registers with the supply of fibers accumulated in the upper end of the branch duct, a kicker roll mounted in each branch duct beneath the associated feed rolls and in registry with the nip formed thereby, drive means connected to said rolls and operative to rotate said rolls in unison, whereby fibers are fed by said feed rolls into the path of the rotating kicker roll which opens the fibers and discharges them downwardly into said batt forming section, suction means connected to the bore of each condenser to maintain the air pressure in said bore lower than the pressure in the upper end of the associated branch duct, whereby air flows downwardly in the branch duct from the upper end thereof to the bore in the associated condenser, means for sensing the pressure differential between the batt forming section of each branch duct and the bore of the condenser associated therewith, means between said surge and said batt froming sections operable to adjust the rate of flow of air through the fibers accumulated in said duct thereby to control the degree of compaction of said accumulated fibers, and means responsive to a change in said pressure differential to effect a corresponding change in the rate of rotation of said feed rolls.

15. Apparatus as defined in claim 14, wherein the last-named means includes means for slowing the rate of rotation of said feed rolls when said pressure differential increases, and for increasing the rate of rotation of said feed rolls when said pressure differential decreases.

16. Apparatus as defined in claim 15, wherein said suction means includes means responsive to the increase in said pressure differential to decrease the rate of air flow through the associated branch duct, and vice versa when said differential decreases.

* * * * *